United States Patent [19]

Bertagnoli

[11] Patent Number: 4,879,884

[45] Date of Patent: Nov. 14, 1989

[54] UNIVERSAL DOUBLE-CYLINDER, MULTI-YARN-FEED CIRCULAR KNITTING MACHINE

[75] Inventor: Leopoldo Bertagnoli, Brescia, Italy

[73] Assignee: Orizio Paolo S.p.A., Brescia, Italy

[21] Appl. No.: 148,648

[22] Filed: Jan. 26, 1988

[30] Foreign Application Priority Data

Feb. 2, 1987 [IT] Italy ..... 19226 A/87

[51] Int. Cl.[4] ..... D04B 9/10; D04B 15/32; D04B 15/78

[52] U.S. Cl. ..... 66/14; 66/54; 66/221; 66/222

[58] Field of Search ..... 66/14, 27, 54, 219, 66/221, 232, 222

[56] References Cited

U.S. PATENT DOCUMENTS

| | | | |
|---|---|---|---|
| 2,412,248 | 12/1946 | Bristow | 66/14 |
| 3,232,079 | 2/1966 | Levine et al. | 66/232 |
| 3,760,188 | 9/1973 | Plath | 66/232 X |
| 4,055,058 | 10/1977 | Tewsley et al. | 66/219 |
| 4,712,390 | 12/1987 | Lonati | 66/54 |

FOREIGN PATENT DOCUMENTS

| | | | |
|---|---|---|---|
| 187269 | 7/1986 | European Pat. Off. | 66/54 |
| 2102063 | 8/1972 | Fed. Rep. of Germany | 66/219 |
| 3616656 | 11/1986 | Fed. Rep. of Germany | 66/221 |

*Primary Examiner*—Wm. Carter Reynolds
*Attorney, Agent, or Firm*—Robbins & Laramie

[57] ABSTRACT

A universal circular knitting machine with a plurality of knitting stations, having two revolving cylinders axially aligned with each other surrounded by cam skirts, selection devices, stitch length regulation devices and yarn selector devices mounted on a stationary structure. Each movable element for determining needle selection and needle vertical movement, along with yarn-guide actuation, is driven by an electromechanical actuator mounted on the stationary structure. A central electronic control unit sends actuation command signals to the electromechanical actuators. The signals are synchronized with the revolution of the cylinders in accordance with a pattern corresponding to a knitted fabric to be produced.

4 Claims, 6 Drawing Sheets

UNIVERSAL DOUBLE-CYLINDER, MULTI-YARN-FEED CIRCULAR KNITTING MACHINE

BACKGROUND OF THE INVENTION

The present invention relates to a circular, two-cylinder knitting machine, commonly denominated "links-links", for the production of tubular knitted fabrics, with plain stitches and purl orrib stitches, and with the possibility of programming a very wide range of different patterns.

A machine of this kind is normally equipped with a plurality of yarn feeds, so as to produce, at each machine revolution, a plurality of courses of knitted fabric, and thus increase the productivity.

For each yarn feed station or knitting station, it is necessary to suitably select the needles from one of three basic knitting positions, i.e., to cause that, for each needle, deciding is possible, whether the needle has to remain inoperative, whether it must operate in plain mode (on the lower cylinder), or in purl mode (on the upper cylinder), or whether it must hold the stitch in plain mode (the so-said "loaded position", wherein the needle takes the new yarn in plain mode, but without releasing the previously formed stitch, retaining it).

In order to perform this selection of the needles, a selection device is associated with each yarn feed station or knitting station, which is mechanically driven, or, in particular in modern machines, is electromechanically or electronically controlled, comprising a plurality of selection members capable of acting on pattern heels of suitable selectors inserted inside the peripheral slots of the lower cylinder of the machine under the needles, normally with the interposition, between the needles and the selectors, of the so-said "needle pushers". The heels of the selectors are positioned at several levels.

The axial movement of the needles inside the respective slots of the cylinders is driven, besides the selection devices, by stationary and movable cams located on skirts surrounding the cylinders.

These machines are furthermore provided with devices for regulating the length of the stitch, and, possibly, with devices, denominated "yarn selectors", associated with the individual yarn feeds, by means of which it is possible to selectively supply to each feed point one from a plurality of yarns of different colours or types. The yarns fed at each yarn feed come from bobbins or cones, supported by cone carriers.

In order to enable the needles to carry out inside the slots housing them, the axial movements, which are necessary for forming the stitch, it is essential to have a mutual revolutionary motion between the cylinders bearing the needles, and the members which select the needles and which cause this up-and-down movements, i.e., the cams provided in the skirts surrounding the cylinders. This mutual revolutionary motion can be obtained with the cylinders being stationary, and the cams and the selection devices being revolving, or with revolving cylinders, and stationary cams and selection devices.

In the multi-yarn-feed, double-cylinder circular knitting machines known from the prior art, resort was made to the first of these two possibilities, with stationary cylinders in the centre of the machine, and with the cam skirts and the selection devices revolving around the stationary cylinders together with the possible yarn selectors, the stitch length regulating devices, and, of course, the yarn feed cones.

This solution was adopted in order to be able to prearrange on one single control station, radially outside the cylinders of the machine, a mechanical control programmer, in order to drive, according to the processing requirements, the selection devices, the movable cams in the cam skirts, and the possible yarn selectors, and other devices. In fact, if the revolving cylinder solution had been adopted, it would have been necessary to have the cylinders revolve in synchronism with the cam control devices, the needle selection devices, the yarn selectors, and so forth, with self-explanatory, practically unsurmountable structural complications.

On the other hand, a machine having stationary cylinders would require various devices for the selection and the drive of the axial movements of the revolving needles with results clearly very complex and cumbersome, if one considers that the frame structure supporting the whole revolving portion of the machine must be very sturdy, and considering the tremendously large revolving mass subject to the centrifugal force, which also considerably limits the revolution speed, and therefore also the production rate of the machine. Furthermore, in a so-conceived machine, the actions for controlling and supervising the machine operation become extremely difficult and dangerous, by being hindered by the external revolving portion of the machine.

The technical problem on which the present invention is based, and for which a solution is proposed, is now that of providing a universal, double-cylinder, multi-yarn-feed circular knitting machine of novel conception, wherein the drawbacks of the machines of this kind known from the prior art are overcome, and installation of the needle drive cams, the needle selector devices, the possible yarn selector devices, the stitch length regolator devices, the yarn guides, the feed cones, and so forth is possible on the stationary structure provided around the revolving cylinders, with less complexity and overall dimensions, greater easeness of operation control and supervision, and possibility of higher revolution speeds, and, therefore, of a higher production rate.

In order to solve this problem, according to the present invention, it is proposed to use electromechanical actuators for driving the movable members destined to act on the needles of the cylinders and on the yarn feed means, with said members and means being installed on the stationary portion of the machine surrounding the revolving cylinders, and to send the actuation signals to said electromechanical drive actuators from a central electronic control unit in synchronism with the revolution of the cylinders, as a function of the pattern of the knitted fabric to be produced, as detected by a pattern analyzer, and processed by a computer.

By operating in this way, it is possible to keep the two revolving cylinders, and all of the drive members stationary, in as much as the signals of actuation for these drive elements are, at is were, made to "travel" at the same speed of the revolving cylinders.

According to a particularly preferred form of a practical embodiment of the present invention, each yarn feed of the machine is equipped with two successive groups of electromechanical selection actuators, such to be able to perform, for each yarn feed, in one single station, the three basic stitch selections, i.e., to select the needles which must remain inoperative in the relevant yarn feed, the needles which must operate in plain mode, or in purl mode, and the needles which must operate in the loaded position in the plain mode.

In this way, also the number of movable cams is decreased, because the machine can operate with only stationary cams associated with the lower cylinders, and with only two movable cams, also equipped with electromechanical actuators, associated with the upper cylinder.

Of course, also the possible yarn selector devices of the machine must be equipped with an electromechanical drive means, as per se known from the prior art.

With the solution provided by the present invention, the structure of the double-cylinder, multi-yarn-feed circular knitting machine is enormously simplified, the overall dimensions thereof are reduced, and the operation control is made easier, besides making it possible the production rate to be considerably increased, both due to the fact that the mass of the revolving part is largely reduced as compared to the machines of the same kind known from the prior art, so that it is possible to increase the revolution speed, and—in the preferred form of the practical embodiment—due to the fact that for each yarn feed, the three basic stitch selections can be carried out on one single station, and not any longer on three stations as it occurs in the prior art, so that it is possible to increase the number of the actually operating yarn feeds.

BRIEF DESCRIPTION OF THE DRAWINGS

The characteristics of the invention, and the advantages resulting from it will be clearer from the following disclosure of an example of practical embodiment thereof, made by referring to the hereto attached drawings, wherein.

DETAILED DESCRIPTION OF THE PREFERRED EMBODIMENTS

Figure 1:
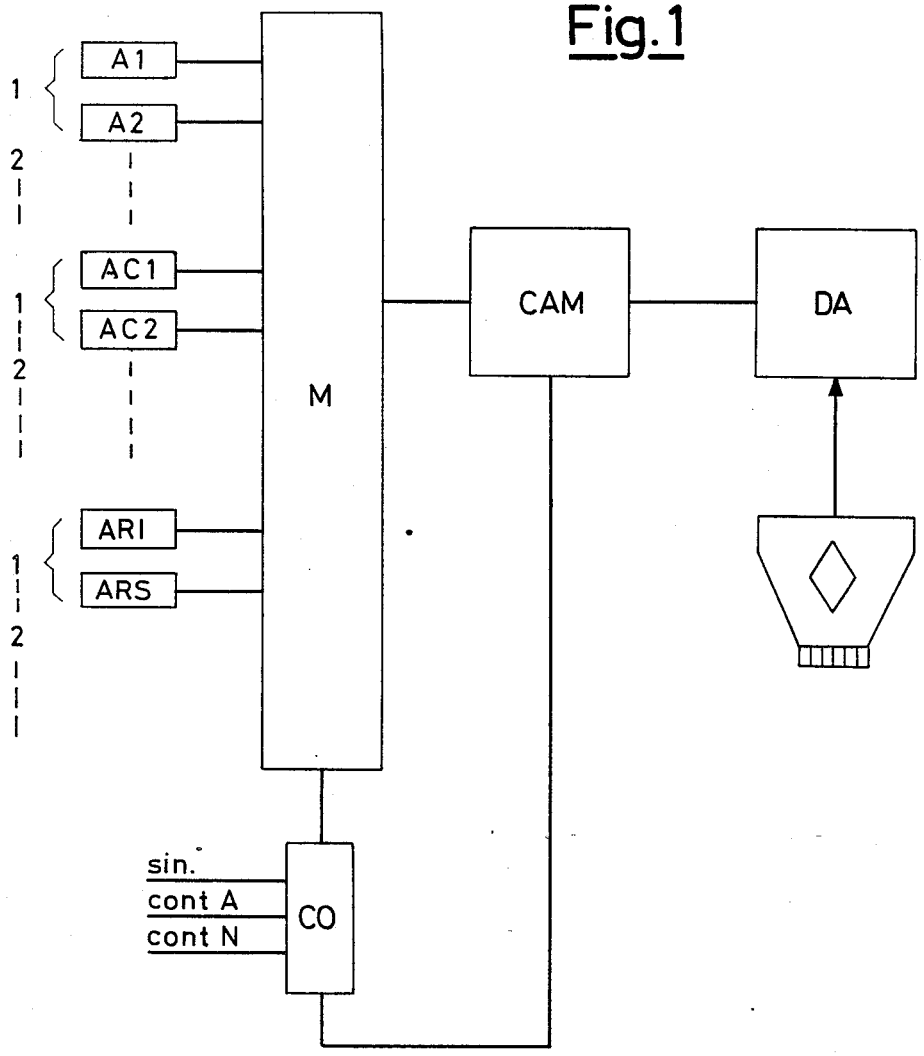
FIG. 1 shows a generic block diagram of the central electronic control unit and of the electromechanical actuators.

Referring first to FIG. 1 of the drawings, in said figure the double-cylinder, multi-yarn-feed circular knitting machine is schematically represented by the block M. With the machine, a central electronic control unit is associated, which substantially comprises a pattern analyzer DA, an on-board computer CAM, and an encoder CO. This latter supplies synchronism signals "sin", needle count signals "cont A" and cylinder revolution count signals "cont N". For each yarn feed or knitting station 1, 2, etc., of the machine (wherein, e.g., 12 or more yarn feeds can be provided), two selection actuators A1 and A2, and two actuators AC1 and AC2, for driving two movable cams C1 and C2 of the upper cam skirt, associated with the upper cylinder of the machine, to their operating position, and to their inoperative position, are provided.

Then, for each yarn feed, actuators ARI and ARS are provided, for the regulation of the length of the plain stitches (lower cylinder) and of the purl stitches (upper cylinder).

The computer CAM, by processing the information received from the pattern analyzer DA and from the encoder CO, sends the command signals to the various actuators, in synchronism with the revolution of the cylinders, as a function of the pattern to be produced.

If the machine is equipped with yarn selector or regulator devices associated with the various yarn feeds, the actuators of these devices can receive the suitable command signals from the computer CAM.

Figure 2:
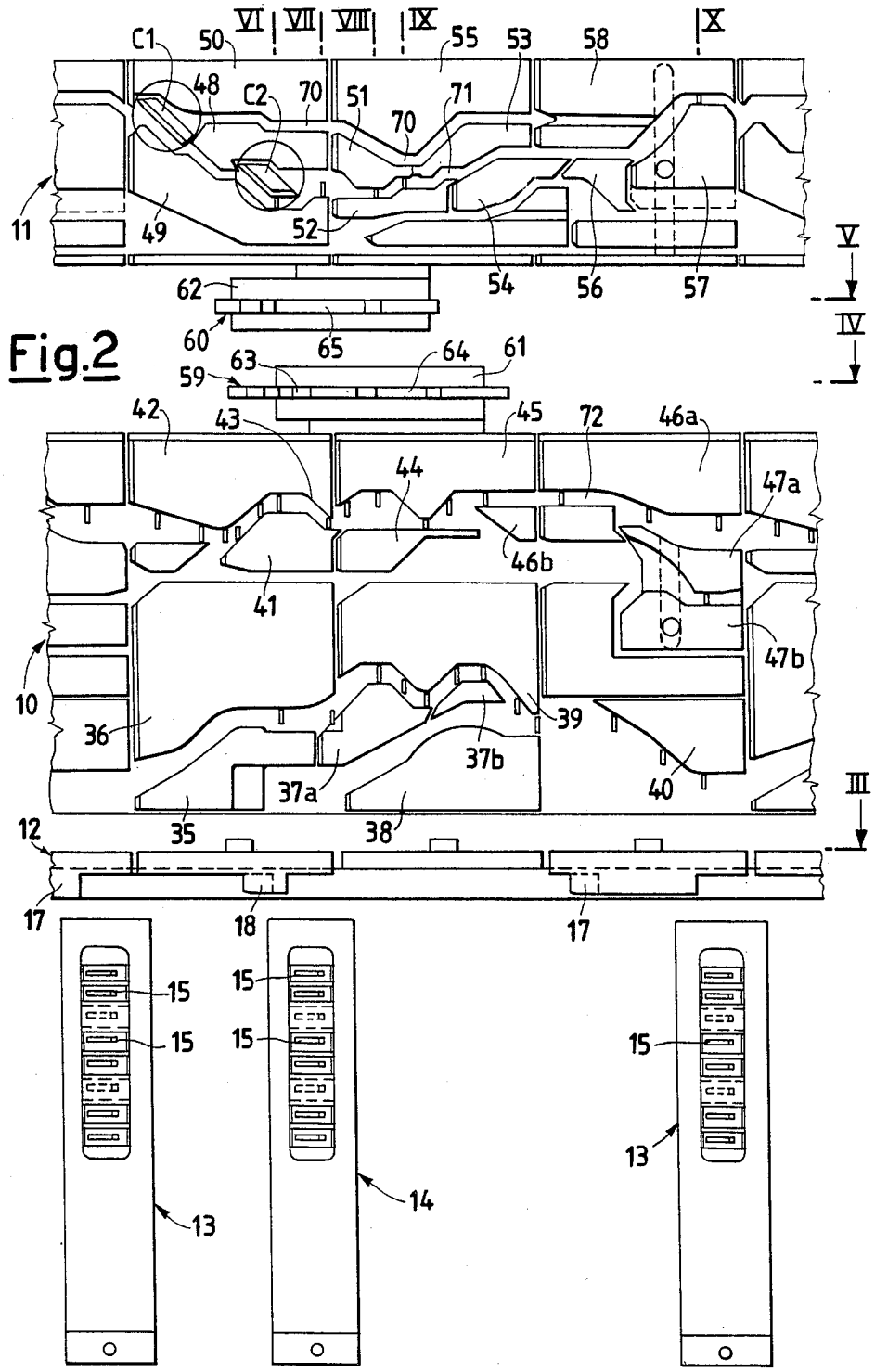
FIG. 2 is a diagram showing the development of the cam skirts and of the needle selection devices for a yarn feed or knitting station of the machine.
Figure 3:
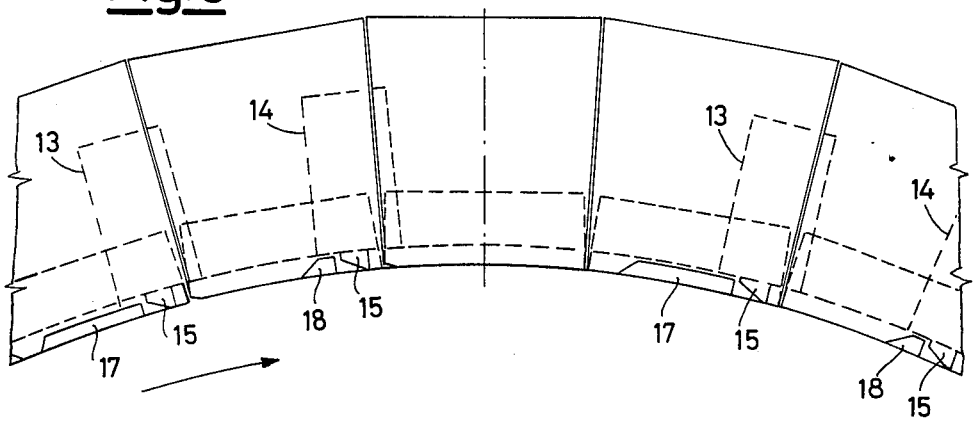
FIGS. 3, 4 and 5 are diagrams showing plan views according to arrows III, IV and V of FIG. 2, and FIGS. from 6 to 10 are diagrams showing vertical sectional views along paths VI–VI, VII–VII, VIII–VIII, IX–IX and X–X of FIG. 2.

In FIG. 2 a portion is shown, in development and seen from the interior, of the stationary part of the machine which surrounds the revolving cylinders, substantially relevant to one yarn feed station or knitting station, this stationary part substantially comprising a lower cam skirt or cambox 10, an upper cam skirt or cambox 11, a ring 12 of stationary extraction cams, and selection devices with electromechanically-driven levers, with two of such devices, indicated by the reference numerals 13 and 14 in FIG. 2, being providd per each yarn feed. These devices 13 and 14 correspond to the selection actuators A1 and A2 shown in FIG. 1.

Each electromechanically or electronically controlled selection actuator can be realized as disclosed in detail in German patent application No. 36 16 656 (see the form of practical embodiment according to FIGS. 8 to 11).

An actuator of this kind comprises, as its selection members, a plurality of selection levers 15, hinged onto a support body 16 according to horizontal and transversal axes relatively to the levers 15. Each lever 15 has a fork-shaped end, wherein an end of an actuation anchor (not shown) engages, which is movable between two angular positions under the action of the magnetic field generated by a coil. Under this coil, a permanent magnet is located, which defines the normal position of the anchor in the absence of a coil excitation. The oscillation of the anchor between the two angular positions causes an equivalent angular shift of the respective lever.

When the coil is de-energized, the relevant lever is lifted and takes such a position (level), as not to interfere with a pattern heel of a respective selector which is discussed in the following. On the contrary, when the coil is excited, the lever is sunk, and takes such a position as to interfere with a relevant pattern heel of the selector. The front edge of the selection levers 15 is inclined and when the levers are in their position of engagement with relevant pattern heels of the selectors, these latter are made oscillate around their lower ends and are pushed into the relevant slots of the lower cylinder which house them.

For a bettr understanding of the operation of these lever actuators, reference is made to the hereinabove mentioned German patent application No. 36 16 656.

With each electromechanical actuator, a stationary extraction cam is associated, and these extraction cams are located on a ring 12. In FIG. 2, the extraction cam associated with the first selection actuator 13 of a yarn feed is indicated by the reference numeral 17, and the extraction cam associated with the second selection actuator 14 is indicated by the reference numeral 18.

Also these extraction cams act on the selectors, as is better explained in the following, and their function is of extracting the selectors, making them correspondingly oscillate around their lower ends.

As it can be seen in FIGS. 6 to 10, the machine comprises two revolving cylinders, axially superimposed to each other, viz., a lower cylinder 19 and an upper cylinder 20. The common axis of these cylinders is to the right in said Figures, and is not visible. The revolution of the two cylinders 19 and 20 around their axis is driven in a per se known way by a purposely provided drive means (not visible) through suitable gearworks (not visible in the figures).

The cylinders 19 and 20 are provided with peripheral vertical slots, such as 21 and 22, visible in FIGS. 6 through 10, and the slots of the upper cylinder 20 are perfectly aligned with the respective slots of the lower cylinder 19. Inside each slot 21 of the lower cylinder 19 there are contained, from down upwards, a selector 23, a needle pusher 24, and a lower slider 25, whilst inside each slot 22 of the upper cylinder 20, an upper slider 26 is inserted. Between the lower slider 25 and the upper slider 26, a double-hook needle 27 is inserted, which needle—according to the selection performed—can be brought on the lower cylinder 19 (in order to produce plain knitted fabric), or on the upper cylinder 20 (in order to produce purl knitted fabric).

The selector 23 is provided with a bottom rounded portion 28, acting as the hinge around which it can oscillate in a known fashion, is provided with a pattern hee or butt 29, and ends, at its top, with a fork 30. In a known way, the pattern heels or pattern butts 29 are located at various levels, corresponding to the levels of the selection levers 15 of the selection actuators 13, 14, with each selector 23 having a single heel 29 at a determined level. In correspondence of the fork 30, the selector 23 is furthermore provided with a tooth 32, with which the extraction cams 17, 18 cooperate.

The needle pushers 24 are with their lower ends always in engagement with the fork-shaped upper end 30 of the relevant selectors 23, and each needle pusher 24 is provided with a heel or butt 31.

Also each lower slider 25 has a heel 33 and at its upper end a seat is provided, which is suitable for receiving the lower hook, with the relevant latch, of the associated needle 27.

Finally, also each upper slider 26 has a heel 34, and, at its lower end, a seat suitable for housing the upper hook with latch of the relevant needle 27.

Figure 7:
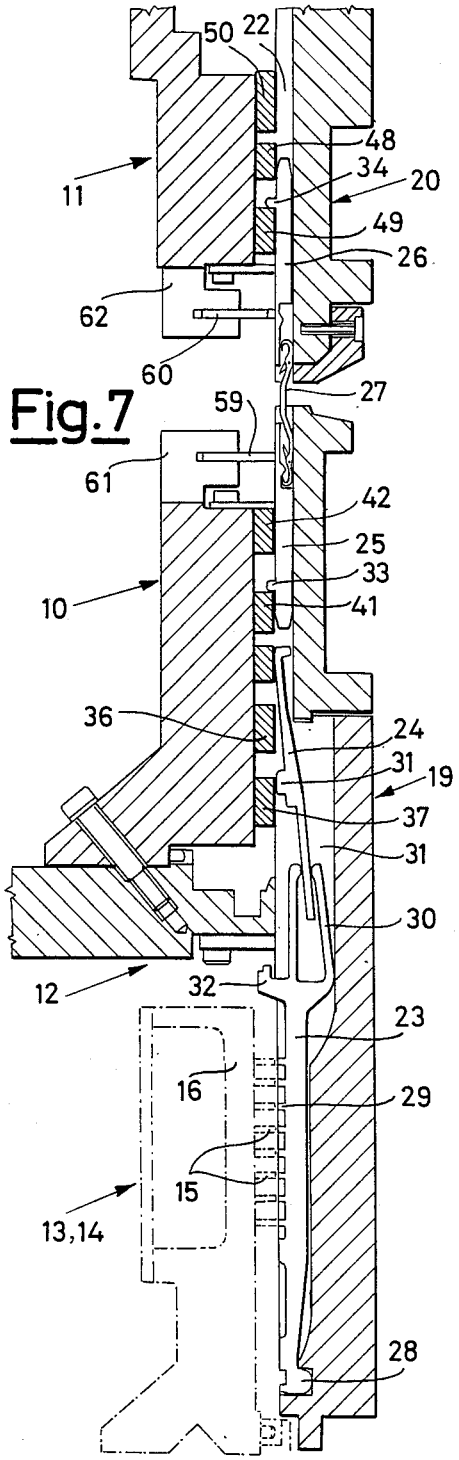

It should be observed that, if a selector 23 is pushed inside its slot 21 by the action of a lever 15 of a selection actuator 13, 14 on its pattern heel or butt 29, the relevant needle pusher 24, due to the engagement of its lower end inside the fork-shaped end 30 of the selector 23, is also made rotate around a temporaneous hinge located in correspondence of its upper end, in such a way that its heel 31 results out of engagement with the cams of the lower skirt 10 (FIG. 7).

The cams of the lower skirt 10 are in fact destined to act both on the heels 31 of the needle pushers 24, and on the heels 33 of the lower sliders 25.

On the contrary, the cams of the upper skirt 11 are destined to act on the heels 34 of the upper sliders 26.

In particular, as results from FIG. 2, the lower skirt 10 substantially comprises, at each yarn feed, in order to act on the needle pushers, a first lifting cam 35 with its relevant counter-cam 36, a second lifting cam and a third lifting cam, respectively 37*a* and 37*b*, with its relevant counter-cam 39 a fourth lifting cam 38 and a sinking cam 40, and, in order to act on the lower sliders, a first lifting cam 41, with its relevant counter-cam 42 provided with the sinking slope 43, a second cam 44 with its relevant counter-cam 45, cams 46*a* and 46*b* which define a so-said "memory" track 72 for the lower sliders 25 of the needle made work in purl mode or rib mode, and a cam 47*a* of formation of plain stitch, with its relevant lower counter-cam 47*b*. The cams 47*a* and 47*b*, which, after the assemblage on the skirt 10, are rigidly constrained to each other, are adjustable in height, as a whole, i.e., they can be vertically shifted together with one another, in order to make it possible the length of the stitch to be regulated when working in the plain mode, as it will be better explained in the following.

On the contrary, the upper cam skirt or cambox 11 substantially comprises, for each yarn feed provided on the machine, in order to act on the upper sliders 26, a first movable sinking cam C1, a stationary sinking cam 48 with an associated second movable sinking cam C2, an associated lower counter-cam 49 and an associated upper counter-cam 50, further couples of cams 51–52 and 53–54 with an associated upper counter-cam 55, a cam 56 and a cam 57 for the formation of purl stitch, with related counter-cam 58. Also the cam 57 for purl stitch formation can be shifted in height, for regulating the length of the stitch.

Between the cams 48, 51 and 53 on one side, and the cams 50, 55 and 58 on the other side, a track 70 is formed for shifting the heels 34 of the upper sliders 26 to their non-operating position, whilst between the cams 51 and 53 on one side, and the cams 52, 54 and 56 on the other side, an operation track 71 is formed.

Figure 4:
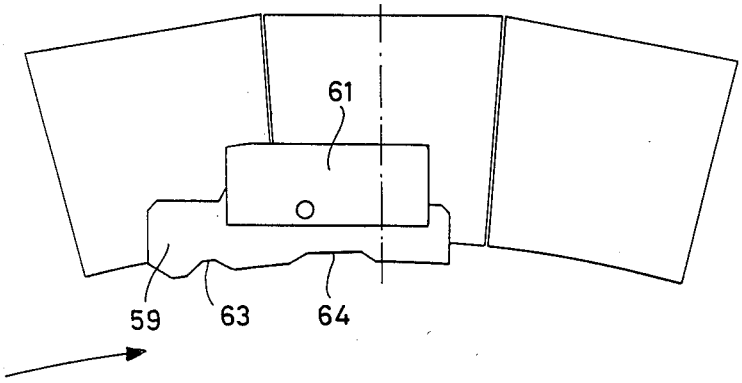
Figure 5:
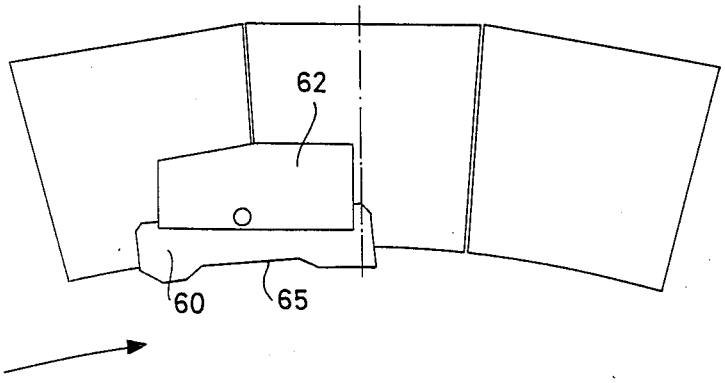

Between the lower cam skirt 10 and the upper cam skirt 11, presses are provided, i.e., a lower press 59 and an upper press 60, mounted on respective supports 61 and 62 (see also FIGS. 4 and 5), which presses are suitable for respectively acting on the lower slider 25 and on the upper slider 26, in order to press the respective sliders towards the end of the slots 21, and, respectively, 22, of the cylinders housing these sliders. The lower press 59 is provided with two undercuts 63 and 64, and the upper press 60 is provided with one single undercut 65, whose purpose will be disclosed in the following.

Figure 6:
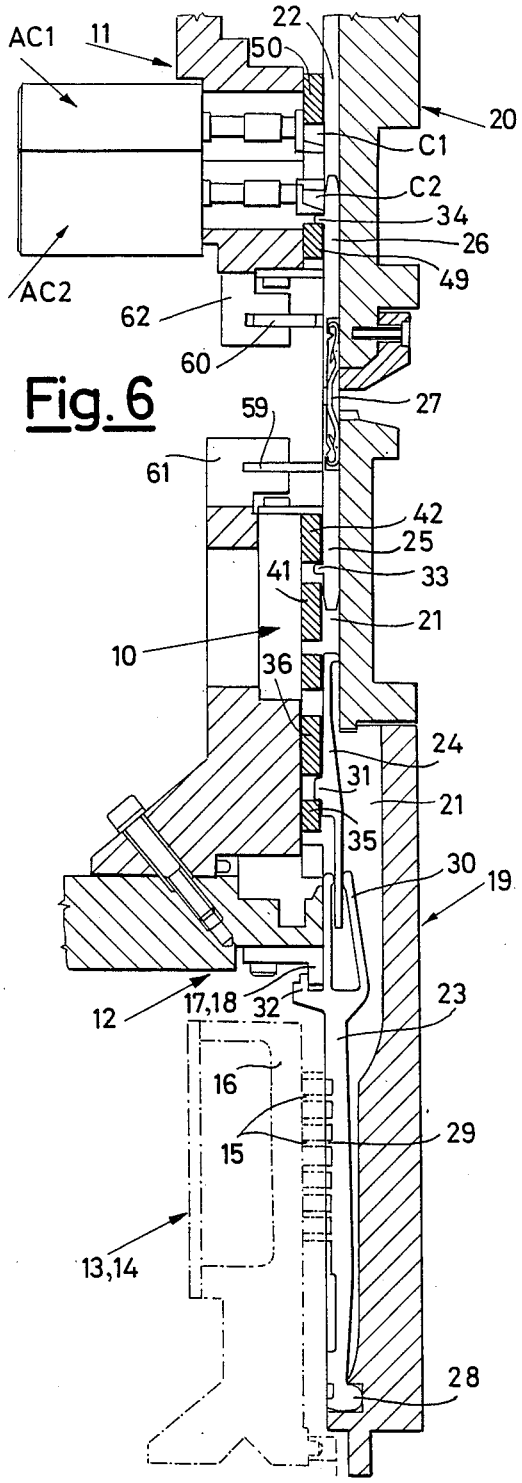

For driving the two movable cams C1 and C2, also double-step electromechanical acturators AC1, and, respectively, AC2, are provided, by means of which the relevant cams C1 and C2 can be alternatively moved to a withdrawn position, wherein they do not act on the heels 34 of the upper sliders 26, and to an inserted position, wherein they act on said heels of the upper sliders 26 (see FIG. 6).

For the adjustment in height of the whole constituted by the cams 47*a* and 47*b*, and, respectively of the cam 57, for stitch formation in plain mode, and, respectively, in purl mode, two electromechanical actuators ARI and ARS are provided (see FIG. 10), which are constituted by stepper motors, capable of being made revolve in both direction; the shafts of these motors bear spiral face cams 66 and respectively 67, which drive a key 68 and respectively 69, to which the whole constituted by the cams 47*a* and 47*b*, and, respectively, the cam 57, which are guided to move along a vertical direction, are fastened. By supplying the actuators ARI and ARS with suitable impulses, it is possible to shift, through small steps, the cams 47*a*–47*b* and 57 between a minimum and a maximum calibration, in the way a very fine regulation being obtained in the length of the stitch, a regulation which can be carried out also many times during each revolution. A check of the accomplishment of the regulation can also be carried out, by means of a suitable feed-back, by sending a return signal to the central electronic control unit. To this end, a suitable potentiometer, or encoder EN, can be provided, which is coupled to the end of the shaft of the relevant motor, opposite to the end on which the spiral face cam is mounted.

From what above disclosed, it is evident how in the double-cylinder, multi-yarn-feed circular knitting machine according to the present invention, the two mutually superimposed cylinders 19 and 20 revolve around their axis, while all of the members which determine the lifting and sinking movement of the needles inside the slots of the cylinders, and the selection of the needles, are mounted on the stationary portion of the machine, wherein the movable members are driven by means of electromechanical actuators, commanded by a central electronic control unit in synchronism with the revolution of the cylinders.

Hereunder, the way for selecting the needles on each yarn feed of the machine is disclosed in greater detail.

This selection must be performed as a function of the pattern of the knitted fabric which has to be manufactured. According to such pattern, at each yarn feed the following requirements may arise:

- the selection of the needles carried out at the preceding yarn feed must be changed;
- the selection of all of the needles as set at the preceding yarn feed must be reconfirmed;
- the selection of the needles which at the preceding yarn feed have operated in plain mode must be reconfirmed, and a portion of the needles which at the preceding yarn feed have operated in purl mode must be put out of operation;
- the selection of the needles which at the preceding yarn feed have operated in plain mode must be changed, and a portion of the needles which at the preceding yarn feed have operated in purl mode must be put out of operation;
- the selection of the needles which at the preceding yarn feed have operated in plain mode must be changed, and the selection of the needles which at the preceding yarn feed have operated in purl mode must be reconfirmed.

These different selection requirements are met, according to the invention, at each yarn feed, by the two electromechanical selection actuators 13 (A1) and 14 (A2), with the associated stationary extraction cams 17, 18 and by the two movable cams C1 and C2 in the upper skirt 11, actuated by the electromechanical actuators AC1 and AC2.

The first extraction cam 17 associated with the first selection actuator 13 (A1), by acting on the teeth 32 of the selectors 23, causes the extraction of all of the selectors 23 and of the needle pushers 24 hooked inside the upper, fork-shaped ends 30 of the same selectors. The second extraction cam 18 associated with the second selection actuator 14 (A2) only causes, on the contrary, the extraction of the selectors, and of the relevant needle pushers, which have been pushed towards the interior of their hollows 21 of the lower cylinder 19 by the first selection actuator 13 (A1). The function of the first selection actuator 13 (A1) is the following:

a. When a determined lever 15 thereof is lifted (i.e., when its relevant coil is de-energized), it does not act on the selectors 23 which have their pattern heel 29 positioned at the level of this lever 15, and the related selectors remain therefore extracted, i.e., in their position as caused by the first extraction cam 17; as a consequence, the heel 31 of the needle pusher 24 hooked to such a selector 23 can be engaged by the first lifting cam 35 which, in cooperation with the relevant counter-cam 36, makes this needle pusher 24 rise through such a distance, that the heel 33 of the lower slider 25 located above said needle pusher can be engaged by the first lifting cam 41, which moves the slider 25 and the associated needle 27 to a neutral hooking level (see FIG. 6), waiting whether this needle has to be moved to operate in plain mode (to the lower cylinder 19), or in purl mode (to the upper cylinder 20);

b. When, on the contrary, a determined selection lever 15 is sunk (the relevant coil of the actuator 13 (A1) is energized), it acts on the selectors 23 which have their pattern heel 29 at the corresponding level, and pushes them towards the interior of the slot 21 of the lower cylinder 19, so that also the relevant needle pushers 24 are pushed inwards, and their heels 31 cannot be engaged by the cam 35; the relevant sliders 25, with their respective needles 27 remain for the moment in their lowered position.

Figure 8:
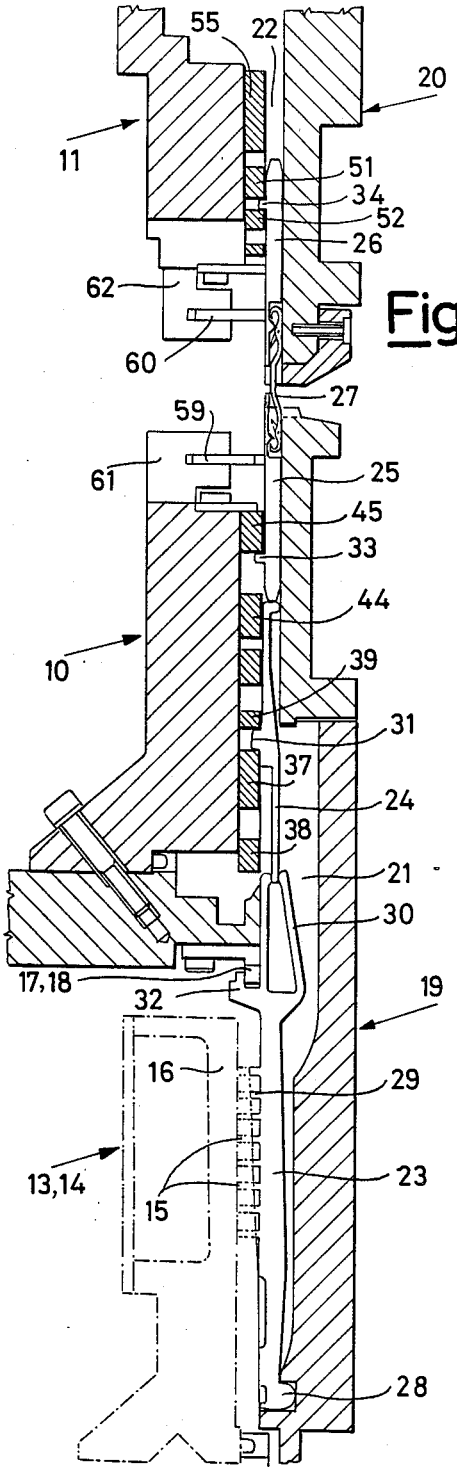
Figure 9:
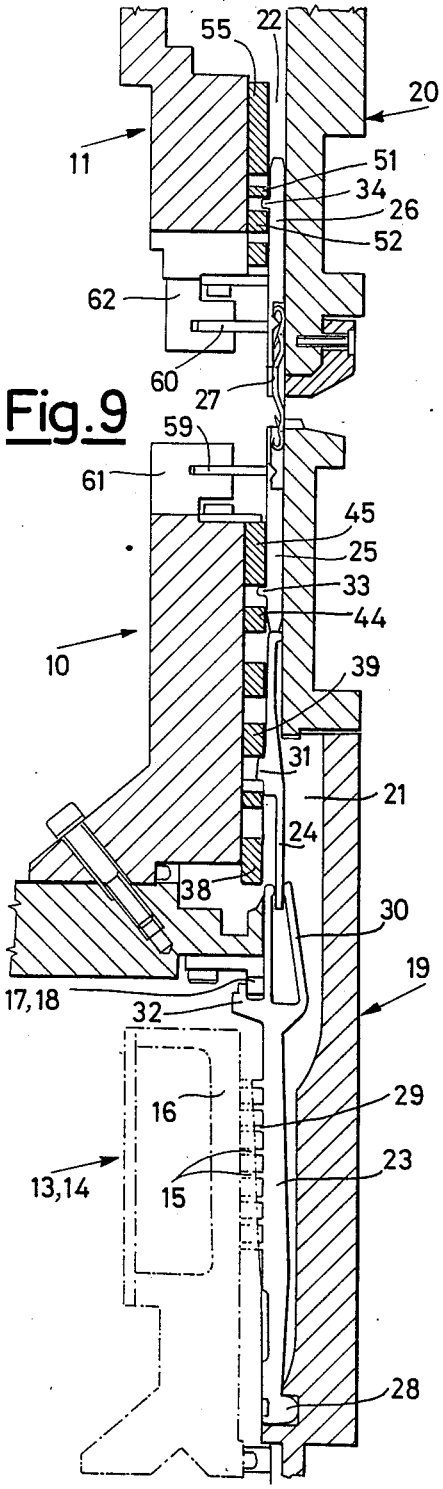
Figure 10:
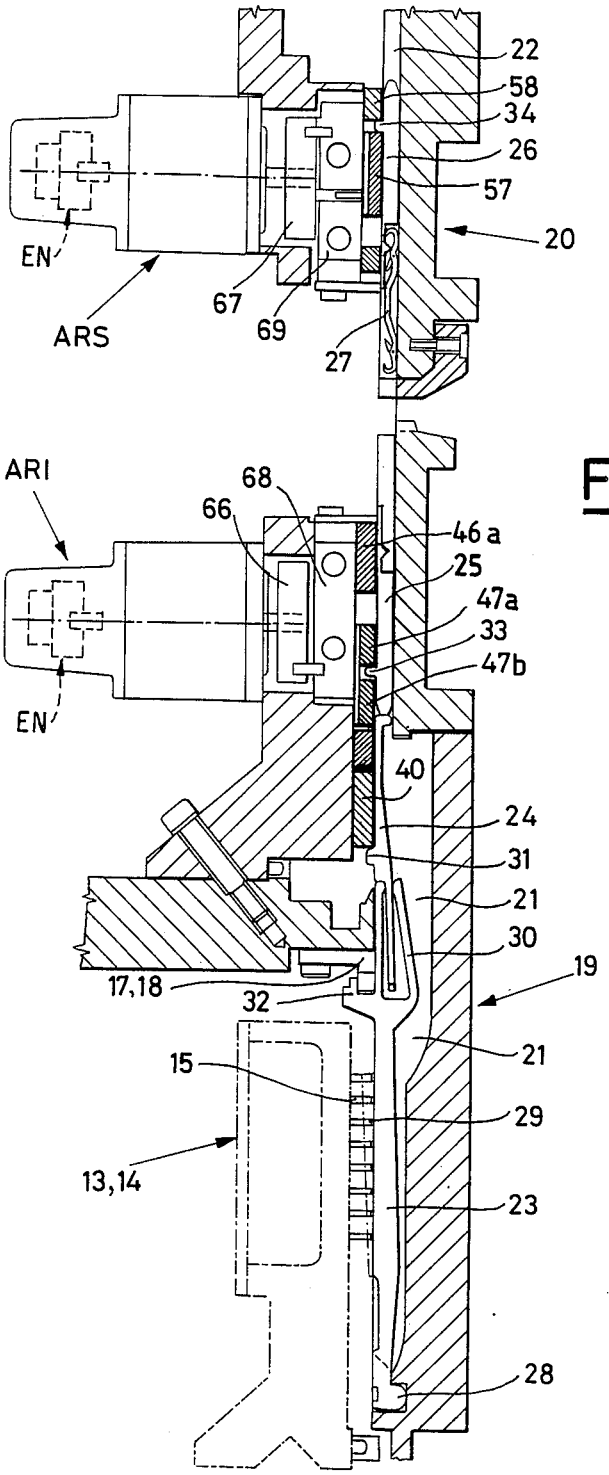

The function of the second selection actuator 14 (A2) is the following:

c. Action on the selectors 23 which have remained lifted (relevant selection levers 15 lifted—see above a condition) in correspondence of the first selection actuator 13 (A1):

$c_1$. Selection lever 15 lifted: it does not act on the selectors 23 whose pattern heel 29 is positioned at the corresponding level, and therefore these selectors, with the relevant needle pushers 24, remain extracted; the needle pushers 24 already made rise by the first cam 35 are made furthermore rise by the second lifting cam **37*a*, and therefore also the relevant lower sliders 25 and needles 27, after a sinking caused by the slope 43 of the counter-cam 42 are returned back to their neutral hooking level, so that these needles can be hooked by the relevant upper sliders 26, and turned to operate in purl mode (in the upper cylinder 20), as shown by FIGS. 8, 9 and 10; the needle pushers 24, after a first new sinking, caused by the counter-cam 39, are then made rise again by the third lifting cam 37*b*, and hence also the relevant lower sliders 25, by now deprived of the needles 27, transferred to operate in purl mode, are automatically routed along the track 72, the so-said "memory" track, which keeps said sliders 25 in such a lifted position, as to make it possible the latches of the needles 27 transferred to operate in purl mode, to be kept and protected, securing their taking of the new yarn; this results of particular importance in case of needles which must repeatedly operate in purl mode, in that keeping the latches of these needles open and protected, is achieved without the addition of any further special needle pushers or sliders, or of additional selection actuators being needed; furthermore, should wrong selections or wrong manoeuvres be carried out by the operator attending the machine, said "memory" track 72 guarantees that the lower slider 25 is always ready to engage the needle operating in purl mode, which may have be either erroneously, or voluntarily brought to a position of "non-operating" or of "loaded", without the relevant lower slider 25** having been priorily selected to receive it;

$c_2$. With a determined selection lever 15 of the second actuator 14 (A2) being sunk (energized coil), this selection lever acts on the selectors 23 whose pattern heel 29 is positioned at the corresponding level, so that these selectors and the relevant needle pushers 24 are pushed towards the interior of their slots, and hence the needle pushers 24 cannot be engaged and made furthermore rise by the second lifting cam 37*a*; the relevant lower sliders 25, made sink by the sinking slope 43 of the counter-cam 42, and under the action of the lower press 59 (the portion between the two undercuts 63 and 64) lead the associated needles to operate in plain mode (in the lower cylinder 19), as shown in FIG. 7, and are then furthermore made sink by the cam 46*b*, for the formation of the stitch by means of the cam 47*a*.

d. Action on the selectors 23 which, in correspondence of the first selection actuator 13 (A1) have been pushed into the interior of the relevant slots 21 (selection levers 15 of the first selection actuator in their lowered position—see above b condition);

$d_1$. With a determined selection lever 15 being lifted (de-energized coil), this lever does not act on the selectors 23 whose pattern heels 29 are located at the corresponding level, so that these selectors, but which have been extracted by the second extraction cam 18, remain extracted, and the relevant needle pushers 24 can be engaged and made rise by the fourth lifting cam 38; as a consequence thereof, the relevant needles 27 are made lift, through the lower sliders 25, to a level (loaded position in plain mode) wherein, although they take the new yarn, viz., operate in plain mode, do not release the preceding stitch;

$d_2$. When a determined selection lever 15 is sunk (energized coil), it acts on the selectors 23 whose pattern heels 29 are located at the corresponding level, so that these selectors and the relevant needle pushers, extracted by the second exctration cam 18, are pushed again into the interior of their slot, and the needle pushers 24 cannot be engaged by the fourth lifting cam 38; hence, the relevant needles, already selected by the first selection actuator 13 (A1) to remain in their lowered position, remain lowered in plain mode, and therefore do not operate.

Summing up, the two selection acturators 13 (A1) and 14 (A2) are therefore capable of establishing, for each needle, one of the three basic knitting positions: non-operation, operation in plain or in purl mode, operation in plain mode in loaded position.

For the selection of the needles which are already on the upper cylinder, i.e., in order to establish, for each yarn feed, whether these needles should remain on the upper cylinder, and operate or not operate in reverse mode, or whether they have to be transferred to the lower cylinder, in the upper cam skirt 11 of the machine, the two movable cams C1 and C2 are provided, which can be driven to take their inwards or outwards position by the relevant electromechanical actuators AC1 and AC2, and are suitable for acting on the upper sliders 26.

In particular, the function of these two movable cams C1 and C2 is the following:

Cam C1:

e. Disengaged position: in this position, the cam C1 does not act on the heels 34 of the upper sliders 26, so that they are not sunk and their heels 34 progress running along the out-of-operation track 70, and the possible relevant needles 27 already previously selected to operate in purl mode remain in the upper cylinder 20, but are not made operate;

f. Engaged position: in this position, the cam C1 acts on the heels 34 of the upper sliders 26, making them sink, so that the possible relevant needles 27 already previously selected to operate in purl mode are led back to operate in purl mode, if the cam C2 results to be in its disengaged position.

Cam C2:

g. Disengaged position: in this position, the cam C2 does not act on the heels 34 of the upper sliders 26 previously sunk by the cam C1 in its f condition, so that the possible relevant needles 27 are not furthermore sunk down, nor are they led to their neutral hooking position, but remain in their position of operation in purl mode, in that the heels 34 of the upper sliders 26 are routed along the operation track 71;

h. Engaged position; in this position, the upper sliders 26, already previously sunk by the cam C1 in its f condition are furthermore sunk, and the possible relevant needles are led to their neutral hooking position, ready to be transferred to the lower cylinder 19, unless they are led back to operate in purl mode by the second selection actuator 14 (C2) in $C_1$ condition (see above), after a selection by the first selection actuator 13 (A1), in its a condition (see above).

The two presses, i.e., the lower press 59 and the upper press 60, have the purpose of causing the double-latch needles 27 to be hooked to the respective lower sliders 25 or upper sliders 26, by pressing these latter towards the bottom of the relevant slots 21 and 22 respectively provided on the lower cylinder 19 and on the upper cylinder 20.

However, in order to make it possible the needles to be transferred from the lower cylinder 19 to the upper cylinder 20, and vice-versa, undercuts, i.e., recessed lengths, are provided, along which they do not apply the compression force to the related sliders 25 and 26.

In the lower press 59 two undercuts 63 and 64 are provided, which are of a limited length, and are separated from each other by a "full" length (FIG. 4), whilst the upper press 60 is provided with a single, longer undercut 65.

The undercut 63 of the lower press 59 makes it possible the needles to be transferred from the upper cylinder to a neutral hooking position, by the effect of the second movable cam C2 (see above h condition), whilst the undercut 64 of the same press makes it possible the needles to be transferred from the lower cylinder to the upper cylinder, by the second selection actuator 14 (A2), in the above disclosed $c_1$ condition. The "full" length of the lower press 59 between the undercuts 63 and 64 enables the same lower press to act on the lower sliders 25 in order to lead downwards the needles to operate in plain mode, when these sliders 25 are sunk by the sinking slope 43 of the counter-cam 42 (see the above disclosed function of the second selection actuator 14 (A2) in $c_2$ condition).

In the upper press 60, the single undercut 65 performs a multiple function: it makes it possible the needles to be led from the lower cylinder 19 to their neutral hooking position (the a condition of the first selection actuator 13 (A1)); furthermore, it makes it possible the upper sliders 26, with their respective needles, to be led to their neutral hooking position by the second movable cam C2 (above disclosed h condition) and, finally, it makes it possible the needles which already were on the upper cylinder to be led back to operate in purl mode by the second selection actuator 14 (A2) in $c_1$ condition, after a selection by the first selection actuator 13 (A1) in its a condition.

In the double-cylinder circular knitting machine above disclosed for exemplifying purposes, yarn selection devices, making it possible a selection to be performed among the various available yarns in the several yarn feeds, are not shown; however, said machine can be cetainly provided with such yarn selector devices, which must be either electromagnetically or electronically driven, as per se known from the art.

I claim:

1. A circular knitting machine equipped with a plurality of knitting stations, the knitting machine comprising:

two coaxially superposed rotatable needle cylinders, each of said cylinders having a plurality of peripheral vertical aligned slots, each of said slots of the lower cylinder having inserted therein a selector element, a needle pusher and a lower slider, an upper slider being inserted in each of said slots of the upper cylinder, a plurality of double-ended needles transferrable between said slots of the lower and upper cylinders being provided for the manufacture of fabrics having rib and plain stitches;

a stationary lower cambox having a plurality of radially fixed cams for cooperating with butts of said selector elements, needle pushers and lower sliders, said lower cambox surrounding said revolving lower cylinder;

a stationary upper cambox having a plurality of radially fixed cams and two radially movable cams for cooperating with butts of said upper sliders, said upper cambox surrounding said revolving upper cylinder;

first and second groups of electromechanical selection actuators each having a movable selection means for engaging the butts of said selector elements in each of said knitting stations, each of said groups of electromechanical selection actuators being preceded in the direction of cylinder revolution by a stationary extraction cam actuable with said selector elements, an electromechanical cam actuator being associated with each of said radially movable cams of said upper cambox for moving the corresponding cam between an operative position, in which the cam is engaged with the butts of the upper sliders, and an inoperative position;

a plurality of regulating devices for regulating the length of the rib and plain stitches formed in each knitting station, said regulating devices being electromechanically driven by means of individual regulating electromechanical actuators;

a plurality of lower and upper presses provided with undercuts for acting on corresponding ones of said lower and upper sliders and for allowing said double-ended needles to be transferred between said cylinders; and a central electronic control unit for sending actuation signals to said electromechanical cam actuators, said electromechanical selection actuators and said regulating electromechanical actuators, said control unit comprising processing means, a pattern analyzer, and an encoder which supplies synchronization signals, a needle counting signal for each cylinder revolution and cylinder revolution counting signals to said processing means, in accordance with rotational movement of said needle cylinders, whereby said processing means emits said actuation signals to said electromechanical cam actuators, said selection actuators and said regulating electromechanical actuators in response to signal input received from said pattern analyzer and from said encoder.

2. A circular knitting machine according to claim 1, wherein each of said regulating electromechanical actuators is comprised of a stepper motor.

3. A circular knitting machine according to claim 2, wherein each of said stepper motors has fitted on a first end of the motor shaft a spiral face cam for driving respective vertically-guided keys leading stitch formation cams to respectively operate in plain stitch mode and in rib stitch mode and, on a second end of the motor shaft, an encoder for generating feed-back impulses to said processing means.

4. A circular knitting machine according to claim 1, wherein a memory track is provided in the lower cambox in each knitting station, to which the butts of the lower sliders, whose needle pushers are selected to rise by both of said first and second groups of electromechanical selection actuators are subsequently automatically routed, said automatic routing is carried out be a third, additional lifting cam acting on the butts of the needle pushers, associated with the second group of electromechanical selection actuators.

* * * * *